United States Patent [19]

Filippi

[11] 4,363,731

[45] Dec. 14, 1982

[54] DEVICE FOR REGULATING THE FLOW OF WASTE WATERS

[76] Inventor: Rodolfo Filippi, Rives de la Morges 1, 1110 Morges, Switzerland

[21] Appl. No.: 208,275

[22] Filed: Nov. 19, 1980

[51] Int. Cl.[3] ..... B01D 21/00

[52] U.S. Cl. ..... 210/532.1

[58] Field of Search ..... 210/767, 800–802, 210/320, 511, 513, 521, 533, 534, 532.1

[56] References Cited

U.S. PATENT DOCUMENTS

| | | | |
|---|---|---|---|
| 3,362,542 | 1/1968 | Stevens | 210/521 |
| 3,725,271 | 4/1973 | Giannotti | 210/767 |
| 3,914,175 | 10/1975 | Kunz et al. | 210/802 |
| 3,962,098 | 6/1976 | Sze | 210/800 X |
| 4,039,458 | 8/1977 | Maisonneuve et al. | 210/513 |
| 4,118,313 | 10/1978 | Hadamovsky et al. | 210/521 X |

*Primary Examiner*—Thomas G. Wyse

*Attorney, Agent, or Firm*—Ostrolenk, Faber, Gerb & Soffen

[57] ABSTRACT

A device for regulating the rate of flow of waste water mixed with clear rainwater is disclosed. The device includes a collector chamber having a first orifice which receives the mixed water and second and third orifices which respectively discharge water containing a high concentration of waste water, and clear water. An adjustable device including first and second conical elements connected in series is mounted between the first and the second orifices. The first conical element has a lateral opening which extends into the second conical element. The effective area of the opening in the second conical element is controlled by a vertically movable shield. A first boss and a second boss settle the turbulence in the mixed water which enters the device. A deflector partially blocks the inside of the first conical element and diverts the lighter clear water through the opening. During floods or storms, water which is laden with heavier waste matter flows through the regulating device and out the second orifice while the less dense clear water is ejected through the opening and into the collector chamber and evacuated through the third orifice.

15 Claims, 2 Drawing Figures

DEVICE FOR REGULATING THE FLOW OF WASTE WATERS

BACKGROUND OF THE INVENTION

The present invention relates to a device for regulating the rate of flow of water comprised of waste water mixed with clear rainwater to a purification station. The invention is particularly useful for handling water flow during or after a flood or a storm. The device is of the type comprising a collector chamber equipped with a first orifice for receiving the mixed water, a second orifice for discharging water containing a higher concentration of waste water, and a third orifice for discharging water containing a higher concentration of clear water. The collector chamber contains an adjustable device for directing a predetermined quantity of water which has a higher concentration of waste water toward the second orifice and for discharging the remaining water containing a higher concentration of clear water into the collector chamber and toward the third orifice.

Following a storm, the rate of flow of mixed waste water and rainwater can be greater than 100 times the rate of flow measured in dry weather. Purificiation stations are generally designed to treat at most twice the dry-weather rate of flow. The specifications for sewers are based at present on a specific dry-weather rate of flow of 0.01 liter/sec. per inhabitant.

In order to eliminate the excessive waste water which is heavily diluted by rainwater, flood weirs or storm weirs, each in the form of a dam with an overflow crest, i.e. a dam surmounted by an overflow crest followed by a charge section, or an overflow dam with charge sections upstream and downstream, are provided at suitable points. Flood weir dams are able to retain surplus water to a certain extent. At least temporarily, there is settling of the mixed water, because the heavier waste water has a tendency to pass to the bottom while the clear water, heavily diluted by rainwater, tends to stay at the upper level. However, precise adjustment of the rate of flow of the waste water fed to the purification station is difficult, and flood weirs have the major drawback of making it impossible to maintain the rate of flow of the water transmitted to a purification station within acceptable limits in case of a sudden flood, in particular after a storm.

Generally, dynamic flow regulating devices of the above-mentioned type do not permit precise regulation of the rate of flow. The rate of flow at the time of floods or after a storm, as noted above, is far greater than twice the value of the rate of flow in dry weather. Furthermore, the turbulence of the entering stream prevents the mixed water from effectively settling, with the result that it is difficult to ensure that only water which has a higher concentration of waste matter is sent to the purification station.

SUMMARY OF THE INVENTION

The object of the present invention is to overcome the foregoing problems by providing a regulating device which enables separating water having a higher concentration of waste matter from water having a lower concentration of waste matter and which, in addition, limits the rate of flow of the water to a purification station to an amount which the purification station is able to treat.

For this purpose, the device in accordance with the invention comprises a collector chamber containing an adjustable device for directing water containing a larger concentration of waste to one outlet orifice for treatment, while directing relatively cleaner water to a second outlet orifice. The adjustable device comprises a pipe formed of two preferably conically shaped elements connected end to end at their wider ends such that their axes form an obtuse angle in a generally horizontal plane. The first conical element has its free, upstream end connected to the inlet orifice and has internal baffles to reduce the turbulence of the incoming stream. The second conical element has its free, downstream end connected to the first outlet orifice. The second element also has an opening whose effective area is controlled by means of a laterally movable shield. The opening is for discharging the surplus mixed water into the collector chamber.

The precisely adjustable regulating device of the invention effectively separates the waste water that is to be transmitted to the purification station from the clearer water, comprised mostly of rainwater. This separation is very important because purification by fermentation and biological reduction becomes more difficult as the waste water becomes more dilute. In order for the purification station to be effective in a period of unusually heavy flow due to a storm or flood, it is therefore of prime importance, on the one hand, that the mass of water which is fed to the purification station not exceed its treatment capacity and, on the other hand, that the waste water not be too dilute. Accordingly, a flood or storm weir system must combine two essential characteristics. It must be able to precisely adjust the rate of flow of the water transmitted to the purification station, and it must be able to effectively separate the denser waste water from the clearer water.

Other objects and features of the present invention will become apparent from the following detailed description of a preferred embodiment of the invention taken in conjunction with the accompanying drawings.

DETAILED DESCRIPTION OF THE INVENTION

Figure 1:
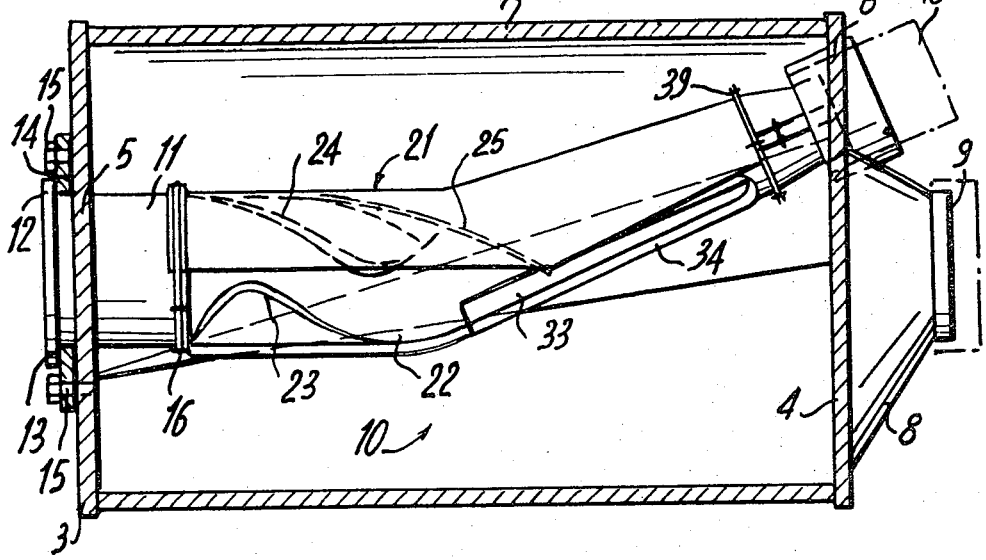
FIG. 1 is a top view in section illustrating the device of the invention.
Figure 2:
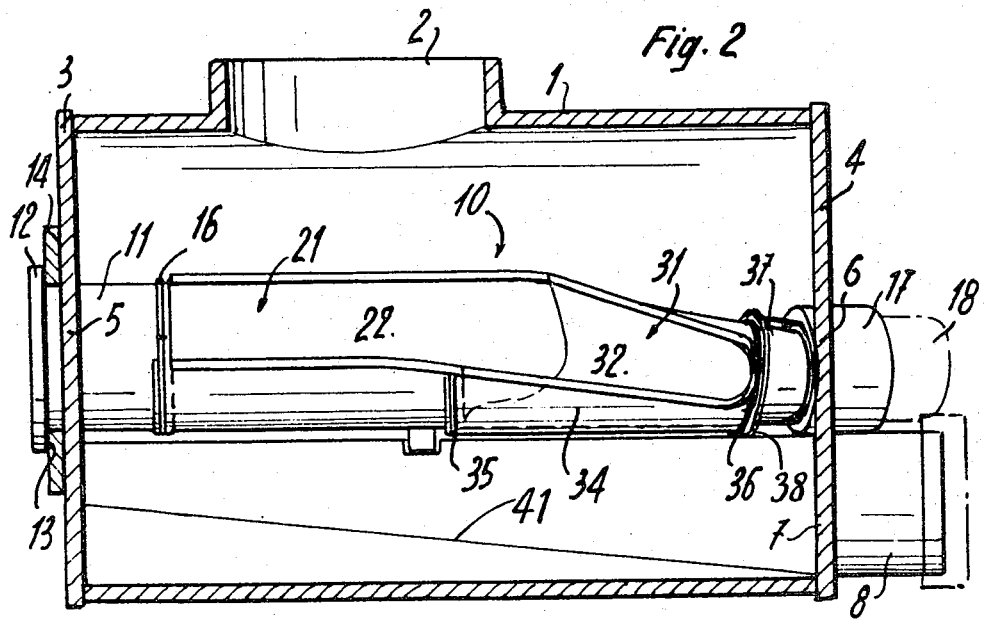
FIG. 2 is a side view in section of the regulating device of the invention.

Referring to the Figures, the collector chamber 1 includes a tank of generally cylindrical shape made in one piece, for instance of fibro-cement, polyester or any other material having sufficient water-tightness and mechanical strength. At its upper side, the chamber 1 has an opening 2 which permits access, and even actual through passage, by maintenance personnel to the regulating device 10 housed therein, which is described in further detail below.

The circular flat end surface 3 of the chamber 1 has a first or inlet orifice 5 formed in it for receiving the mixed waste and rain water. The opposite end face 4 of the chamber 1 has second and third outlet orifices 6 and 7 formed in it. The second outlet orifice 6 discharges water containing waste matter, while the third outlet orifice 7 discharges relatively clear water. A conical part 8 is attached to the exterior of end face 4 over the third orifice 7 for the purpose of collecting the relatively clear water discharged by the chamber 1 and directing it toward a conduit (not shown) which commences at the mouth 9 of the conical part 8.

A cylindrical sleeve 11, the outside diameter of which corresponds to the diameter of the inlet orifice 5 and to the inside diameter of the inlet of the adjustable device 10, is inserted in the first orifice 5. The sleeve 11 extends through orifice 5 to the exterior of the chamber 1. There the sleeve 11 has a rim 12 with an annular shoulder 13 which rests against a flat, for instance, rectangular, plate 14. The plate 14 may be displaced vertically, for instance, by sliding in lateral guides (not shown) that are fastened vertically on the end face 3 of the collection chamber 1, or by cooperation of the fastening bolts 15 located in suitable boreholes in the end face 3 with vertical slots (not shown) provided in the plate 14. Vertical movement of the plate 14 in this manner serves to adjust the position of the first orifice 5. The sleeve 11 is connected, for instance, by means of a circular clamping flange 16 to the inlet of the adjustable device 10.

The second, outlet orifice 6, arranged at the opposite end of the regulating device 10, preferably also has a sleeve 17 inserted in it. Sleeve 17 is mounted on a vertical adjustment device (not shown) which can be designed on the same principles as the one fastened to the other flat face 3. The sleeve 17 is used to connect the adjustable device 10 to a pipe which starts at 18 and conducts the waste water toward the purification station.

The adjustable device 10 comprises a first conical element 21 formed of an externally cylindrical pipe length which has inner walls that are cone-shaped and which widen in the downstream direction. Conical element 21 has a lateral opening 22 which extends over is entire length and which has an area equal approximately to one-fourth of the lateral surface of the cylindrical pipe. The position of the opening 22 corresponds to the first quadrant, considered trigonometrically, i.e., the upper right quadrant, as seen looking downstream. Because the opening 22 is nearer the top of element 21, the heavier water settles beneath the opening 22 moving through element 21.

The first conical element 21 is connected at its wider downstream end to the wider upstream end of a second conical element 31 that is arranged approximately in the same horizontal plane or is slightly inclined with respect to the horizontal. The longitudinal axes of the two conical elements 21 and 31 form an obtuse angle, i.e., the flow passage for the waste water forms an elbow between the first and the second conical elements 21 and 31.

The first conical element 21 contains a first boss 23 comprising a bulge attached to the lateral interior face of the pipe section 21 or formed directly by the stamping of the lateral face, arranged below the lateral opening 22 and extending about the circumference of the pipe 21 approximately to the bottom of the pipe, i.e., it extends over the part of the lateral surface corresponding to the second (lower right) quadrant, looking downstream. The first boss 23 reduces the turbulence of the entering stream and diverts the course of the lower layer of entering water, which is the portion of the incoming water containing a higher proportion of waste water, which, as noted above, is denser than rainwater.

A second boss 24 is located downstream from the first boss 23 to intercept the stream diverted by the first boss 23 in order to cause the stream to undergo a second deviation in a direction opposite to the first deviation. The second boss 24 is also formed of an enlargement, which is arranged inside the opposite lateral face of the pipe 21 from the first boss 23, which corresponds to the third quadrant, considered trigonometrically, looking downstream. The two bosses 23 and 24 cooperate to impart an S-shaped pathway to the lower layer of the water stream, i.e. the layer whose height corresponds at least approximately to half the diameter of the pipe section 21, and to calm the stream and to eliminate turbulence from it.

The downstream flank of the second boss 24 is extended by a deflector 25, which forms an acute angle with the axis of the first conical element 21. The deflector 25 at least partially obstructs the inside of the first conical element 21 in the region of its connection with the second conical 31 element. The deflector 25 is located in the fourth quadrant of element 21, looking downstream.

The second conical element 31 has an opening 32 which is an extension along the second conical element 31 of the lateral opening 22 of the first conical element 21. The opening or slot 33 lies at least in part in the second quadrant of the lateral surface of the second conical section 31, as seen looking downstream. The second opening 33 is blocked to an adjustable degree by a shield 34 having the shape of a frustoconical segment which slides, for instance, in lateral slides 35 and 36, or which may be mounted on the side wall of the second section 31 by any other suitable known means.

The upstream end of the second conical element 31 is preferably connected by welding to the first conical element 21, while the downstream end of the element is fitted in a cone 37, made for instance of reinforced polyester, which serves as a coupling between the second conical element 31 and the sleeve 17. The cone 37 is preferably open along one of its generatrices and is clamped in position by means of a suitable conventional clamping device 38. The cone 37 is connected to the second conical element 31 by an annular flange 39 or by any other suitable means.

When waste water mixed with rainwater enters the first orifice 5, the turbulence in the incoming stream is eliminated by baffles or bosses 23 and 24. The denser water containing a high concentration of waste matter settles to the bottom of the conical elements 21 and 31, while the lighter, relatively clean water is deflected by deflector 25 through the slot 33, into a gutter 41 located at the bottom of the chamber 1, and from there, it passes out through the third orifice 7.

When the regulation device of the invention is installed, a suitable inclination for the adjustable device 10 within the chamber 1 is selected. This inclination may vary between 5 and 15 percent. The opening of the closure shield 34 is also adjusted so that the amount of water passing through the device 10 from the first orifice 5 to the second outlet orifice 6, i.e. the rate of flow of water transmitted to the purification station, is always less than twice the normal rate of flow at the inlet 5, whatever the total rate of flow at any given time. By way of example, an embodiment whose second conical element 31 has an upstream diameter equal to 50 cm and a downstream diameter equal to 35 cm transmits an amount of waste water of 27 to 54 liters/second to the purification station for a rate of flow of mixed water entering through the first orifice 5 ranging from 27 to 400 liters/second. Larger or smaller dimensions may be chosen to meet all local requirements.

It follows from the example given above, as well as from all of the results of other measurements made, that with suitable adjustment of the shield 34 and a suitable inclination of the device 10, the maximum rate of flow of the water transmitted to the purification station always remains less than twice the minimum normal rate of flow. Therefore, the purification station will receive only the amount of water which it can actually treat, regardless of the amount of water entering at the inlet. The device of the invention therefore serves as a safety valve for the purification station.

The present invention may be embodied in other specific forms without departing from the spirit or essential attributes thereof, and, accordingly, reference should be made to the appended claims, rather than to the foregoing specification, as indicating the scope of the invention.

What is claimed is:

1. A device for regulating the rate of flow of waste water which has mixed with clear rainwater and which is to be transmitted to a purification station, comprising:

a collector chamber having a first orifice for receiving waste water and clear water, a second orifice for discharging water containing a higher concentration of waste matter, and a third orifice for discharging water containing a lower concentration of waste matter; and an adjustable device housed in said collector chamber for causing a predetermined maximum quantity of water containing a higher concentration of waste matter to be discharged through said second orifice and for causing the remaining water admitted to said collector chamber via said first orifice to be discharged through said third orifice; said adjustable device comprising:

a first conical element having one end connected to said first orifice for receiving water admitted therethrough, and containing baffle means for reducing turbulence in the admitted water; said first conical element having an opening formed therein which permits outlet of water therethrough from said first conical element; and a second conical element; said two conical elements being oriented with their wider bases toward each other and the conical elements being connected to each other end to end in such a manner that their axes form an obtuse angle in a generally horizontal plane; said second conical element having an end connected to said second orifice for discharging therethrough water having a higher concentration of waste matter; and said second conical element containing a slot the effective area of which is adjustable, for discharging the remaining water into said collector chamber for discharge via said third orifice.

2. The device of claim 1, wherein said opening in said first conical element is continuous with said slot formed in said second conical element.

3. The device of claim 2, wherein said adjustable device has an upper portion and a lower portion and wherein said slot and said opening are located generally in the upper portion of said conical elements.

4. The device of claim 1, wherein said second conical element supports a movable shield for controlling the effective area of said slot.

5. The device of claim 4, wherein said second conical element has grooves formed therein, said shield having portions received slidably in said grooves for enabling said shield to slidably move for controlling the area of said slot.

6. The device of claim 1, wherein said slot is disposed generally in the first quadrant of said second conical element as seen looking downstream.

7. The device of claim 6, wherein said slot extends into the second quadrant of said second conical element toward the downstream end of said slot, as seen looking downstream.

8. The device of any of claims 1, 6 or 7, wherein said opening is disposed generally in the first quadrant of said first conical element, as seen looking downstream.

9. The device of claim 1, wherein said baffle means comprises a first boss disposed on the interior wall of said first conical element in the second quadrant thereof as seen looking downstream.

10. The device of claim 9, wherein said baffle means further comprises a second boss disposed on the interior wall of said first conical element at a location downstream of said first boss and in the third quadrant of said first conical element, as seen looking downstream.

11. The device of claim 10, further comprising a deflector means disposed in said conical elements, and at least partly in said first conical element, in the vicinity of the junction between said first and second conical element; said deflector means defining an acute angle with said axis of said first concial element and being located in the fourth quadrant of said first conical element, as seen looking downstream; said deflector means being oriented for direcing some water in said second conical element through said slot.

12. The device of claim 1, wherein said collector chamber has a top and a bottom, and wherein the locations of said first and second orifices are vertically adjustable relative to said top of said collector chamber for axially inclining said adjustable device relative to said collector chamber.

13. The device of claim 1, wherein said collector chamber has an upper and a lower portion and further comprises gutter means arranged in said lower portion for carrying the remaining water to said third orifice.

14. The device of claim 1, wherein said collector chamber is substantially cylindrical in shape.

15. The device of claim 1, wherein said collector chamber has an opening defined therein large enough to permit personnel to enter said collector chamber.

* * * * *